US007043929B2

(12) United States Patent
Wang

(10) Patent No.: US 7,043,929 B2
(45) Date of Patent: May 16, 2006

(54) ALCOHOLIC BEVERAGE DISPENSER WITH TEMPERATURE CONTROL

(76) Inventor: I-Feng Wang, 3F, No. 12, Sec. 3, Chang-Jung Rd., Tainan City (TW)

( * ) Notice: Subject to any disclaimer, the term of this patent is extended or adjusted under 35 U.S.C. 154(b) by 126 days.

(21) Appl. No.: 10/806,403

(22) Filed: Mar. 23, 2004

(65) Prior Publication Data

US 2005/0211728 A1 Sep. 29, 2005

(51) Int. Cl.
*B67D 5/62* (2006.01)

(52) U.S. Cl. ..... 62/188; 62/389; 222/146.6

(58) Field of Classification Search ..... 62/389–400, 62/354, 428–429, 188; 222/146.6
See application file for complete search history.

(56) References Cited

U.S. PATENT DOCUMENTS 2,912,142 A * 11/1959 Schultz ..... 222/129
3,069,872 A * 12/1962 Sorensen et al. ..... 62/391
3,323,681 A * 6/1967 Di Vette et al. ..... 222/129.1
3,495,612 A * 2/1970 Learn et al. ..... 137/209
3,557,868 A * 1/1971 Burkell ..... 165/71
3,824,801 A * 7/1974 Laudato, Jr. ..... 62/201
4,476,690 A * 10/1984 Iannelli ..... 62/198
4,531,383 A * 7/1985 Zimmermann ..... 62/457.4
5,819,547 A * 10/1998 Oh ..... 62/188
6,293,335 B1 * 9/2001 Tawney et al. ..... 165/156
6,405,555 B1 * 6/2002 Rowland et al. ..... 62/390

* cited by examiner

*Primary Examiner*—William E. Tapolcai
(74) *Attorney, Agent, or Firm*—Harness, Dickey & Pierce, P.L.C.

(57) ABSTRACT

An alcoholic beverage dispenser includes a housing, a holding tank, a cap member, a cooling device, and a dispensing valve. The housing has a top end formed with a beverage inlet. The holding tank is mounted in the housing, is in fluid communication with the beverage inlet, and is adapted to hold an alcoholic beverage that was poured into the housing through the beverage inlet. The cap member is disposed removably on the top end of the housing for closing the beverage inlet. The cooling device is mounted in the housing, is coupled to the holding tank, and is operable so as lower the temperature of the alcoholic beverage held in the holding tank. The dispensing valve is mounted on the housing, is coupled to the holding tank, and is operable so as to permit discharging of the alcoholic beverage from the holding tank.

17 Claims, 6 Drawing Sheets

ALCOHOLIC BEVERAGE DISPENSER WITH TEMPERATURE CONTROL

BACKGROUND OF THE INVENTION

1. Field of the Invention

The invention relates to a beverage dispenser, more particularly to an alcoholic beverage dispenser with temperature control.

2. Description of the Related Art

Some alcoholic beverages are preferably cooled or heated to enhance the flavor thereof. For instance, alcoholic beverages that are preferably cooled before consumption include vodka, grape wine, champagne, etc., whereas alcoholic beverages that are preferably heated before consumption include sake, Chinese wine, etc.

A conventional way of cooling an alcoholic beverage involves putting ice cubes in a cup that contains the alcoholic beverage. Though convenient in practice, the alcoholic beverage loses some of its original flavor as a result of dilution by the ice cubes. On the other hand, when heating an alcoholic beverage, the alcoholic beverage is first poured into a container, which is subsequently placed directly on a stove or in a hot water bath. The heating process as such is inconvenient to conduct, and the temperature of the alcoholic beverage can hardly be controlled.

SUMMARY OF THE INVENTION

Therefore, the object of the present invention is to provide an alcoholic beverage dispenser with temperature control so as to overcome the aforesaid drawbacks associated with the prior art.

According to the present invention, an alcoholic beverage dispenser comprises a housing, a holding tank, a cap member, a cooling device, and a dispensing valve. The housing has a top end formed with a beverage inlet. The holding tank is mounted in the housing, is in fluid communication with the beverage inlet, and is adapted to hold an alcoholic beverage that was poured into the housing through the beverage inlet. The cap member is disposed removably on the top end of the housing for closing the beverage inlet. The cooling device is mounted in the housing, is coupled to the holding tank, and is operable so as lower the temperature of the alcoholic beverage held in the holding tank. The dispensing valve is mounted on the housing, is coupled to the holding tank, and is operable so as to permit discharging of the alcoholic beverage from the holding tank.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
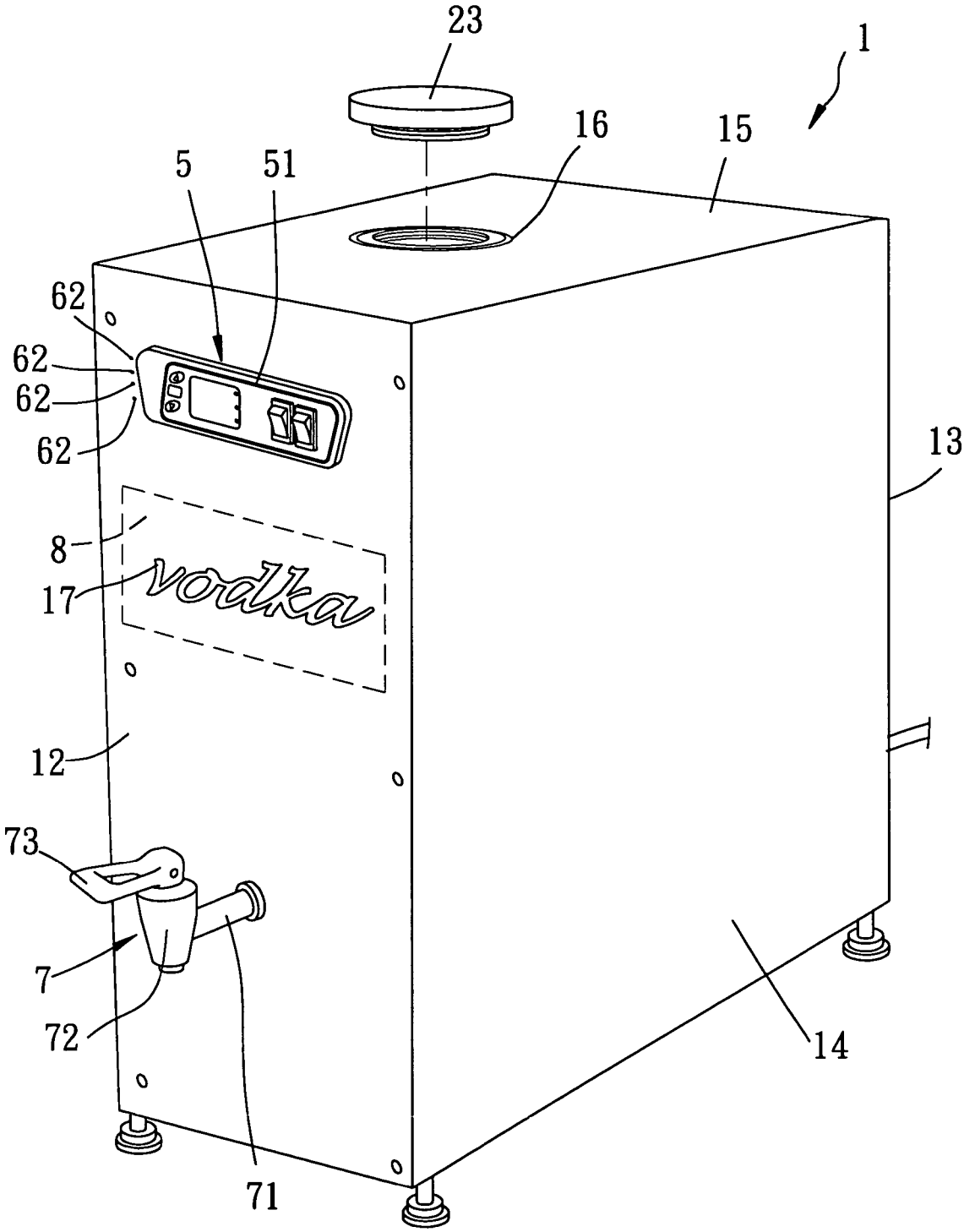
FIG. 1 is a partly exploded perspective view of the preferred embodiment of an alcoholic beverage dispenser with temperature control according to the present invention.

Referring to FIGS. 1 to 4, the preferred embodiment of an alcoholic beverage dispenser according to the present invention is shown to include a housing 1, a holding tank 2, a cap member 23, a cooling device 3, a heating device 4, a temperature setting device 5, a level-sensing device 6, a dispensing valve 7, a front lamp unit 8, and a bottom lamp unit 9.

The housing 1 includes a bottom wall 11, a front wall 12 extending uprightly from a front edge of the bottom wall 11, a rear wall 13 extending uprightly from a rear edge of the bottom wall 11, a pair of lateral walls 14 interconnecting the front and rear walls 11, 12 and extending uprightly and respectively from lateral edges of the bottom wall 11, and a top wall 15 opposite to the bottom wall 11 and connected to the front, rear and lateral walls 12, 13, 14. The front, rear and lateral walls 12, 13, 14 serve as a peripheral wall of the housing 1. The top wall 15 is formed with a beverage inlet 16. In this embodiment, the front wall 12 is formed with a decorative cutout 17, which may be in the form of characters or images, such as a trademark, etc. In practice, at least one of the front, rear and lateral walls 12, 13, 14 is detachable from the housing 1 to facilitate maintenance and repair of the alcoholic beverage dispenser.

The holding tank 2 is mounted uprightly in the housing 1, and includes an inner container 21 and a thermal insulating sleeve 22. The inner container 21 is made of a heat-conductive material, such as metal, and has an open top 211 in fluid communication with the beverage inlet 16. The inner container 21 is thus adapted to hold an alcoholic beverage that was poured into the housing 1 through the beverage inlet 16. In this embodiment, the inner container 21 is made of stainless steel, and has an outer surface formed with a helical groove 212. The thermal insulating sleeve 22 is made of a thermal insulating material, such as a foam material, and covers the outer surface of the inner container 21.

The cap member 23 is disposed removably on the top wall 15 of the housing 1, and serves to close the beverage inlet 16. In this embodiment, the cap member 23 extends into the beverage inlet 16, and engages threadedly the open top 211 of the inner container 21 of the holding tank 2.

Figure 6:
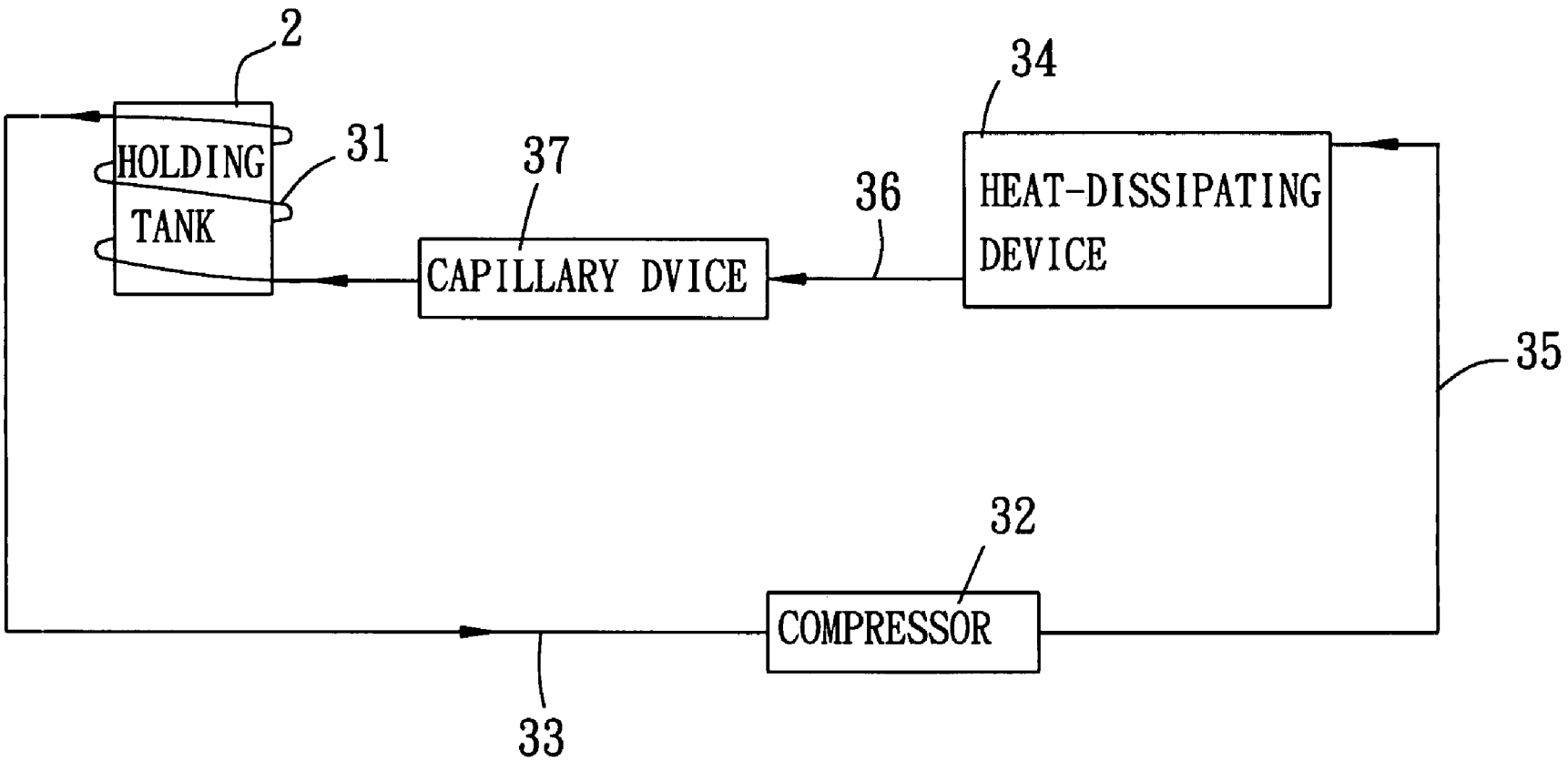
FIG. 6 is a block diagram to illustrate how a coolant of a cooling device circulates in the preferred embodiment.

The cooling device 3 is mounted in the housing 1, is coupled to the holding tank 2, and is operable so as lower the temperature of the alcoholic beverage held in the holding tank 2. With further reference to FIG. 6, the cooling device 3 of the alcoholic beverage dispenser of this embodiment includes a heat-exchanging pipe 31 wound around the inner container 21 along the helical groove 212 and covered by the thermal insulating sleeve 22, a compressor 32, a first pipe 33 for coupling the compressor 32 to the heat-exchanging pipe 31, a heat-dissipating device 34, a second pipe 35 for coupling the compressor 32 to the heat-dissipating device 34, a third pipe 36 coupled to the heat-dissipating device 34, a capillary device 37 interconnecting the third pipe 36 and the heat-exchanging pipe 31, and a coolant (such as a fluorochlorocarbon composition) circulating through the heat-exchanging pipe 31, the first pipe 33, the compressor 32, the second pipe 35, the heat-dissipating device 34, the third pipe 36 and the capillary device 37. Since the heat-exchanging pipe 31 is wound along the helical groove 212 in the outer surface of the inner container 21, the contact area between the heat-exchanging pipe 31 and the inner container 21 is increased to enhance the heat-dissipating effect. Preferably, the capillary device 37 includes a bundle of capillary tubes bound together by adhesive tape. Moreover, in this embodiment, a fan 38 is mounted on the housing 1 and serves to dissipate heat generated by the heat-dissipating device 34.

The heating device 4 is mounted on the holding tank 2 and is operable so as to raise the temperature of the alcoholic beverage held in the holding tank 2. In this embodiment, the heating device 4 includes an electric heating rod 41 that extends into the inner container 21 of the holding tank 2.

The temperature setting device 5 is mounted on the housing 1, is coupled to the cooling device 3 and the heating device 4, and is operable so as to detect the temperature of the holding tank 2 and so as to control operation of one of the cooling device 3 and the heating device 4 for adjusting the temperature of the holding tank 2 to a user-defined value. The temperature setting device 5 includes a control panel 51, a temperature sensor 52, and a controller 53. The control panel 51 is mounted on the front wall 12 of the housing 1 and is operable so as to set the user-defined value and so as to set operation of the temperature setting device 5 in a selected one of a cooling mode and a heating mode. The temperature sensor 52 is mounted on the holding tank 2 to detect the temperature of the holding tank 2. In this embodiment, the temperature sensor 52 extends into the inner container 21 of the holding tank 2. The controller 53 is mounted in the housing 1 and is coupled electrically to the control panel 51, the temperature sensor 52, the cooling device 3 and the heating device 4. In use, the controller 53 activates the cooling device 3 when the temperature setting device 5 is operated in the cooling mode, and the temperature detected by the temperature sensor 52 is higher than the user-defined value set through the control panel 51. On the other hand, the controller 53 activates the heating device 4 when the temperature setting device 5 is operated in the heating mode, and the temperature detected by the temperature sensor 52 is lower than the user-defined value set through the control panel 51.

Figure 2:
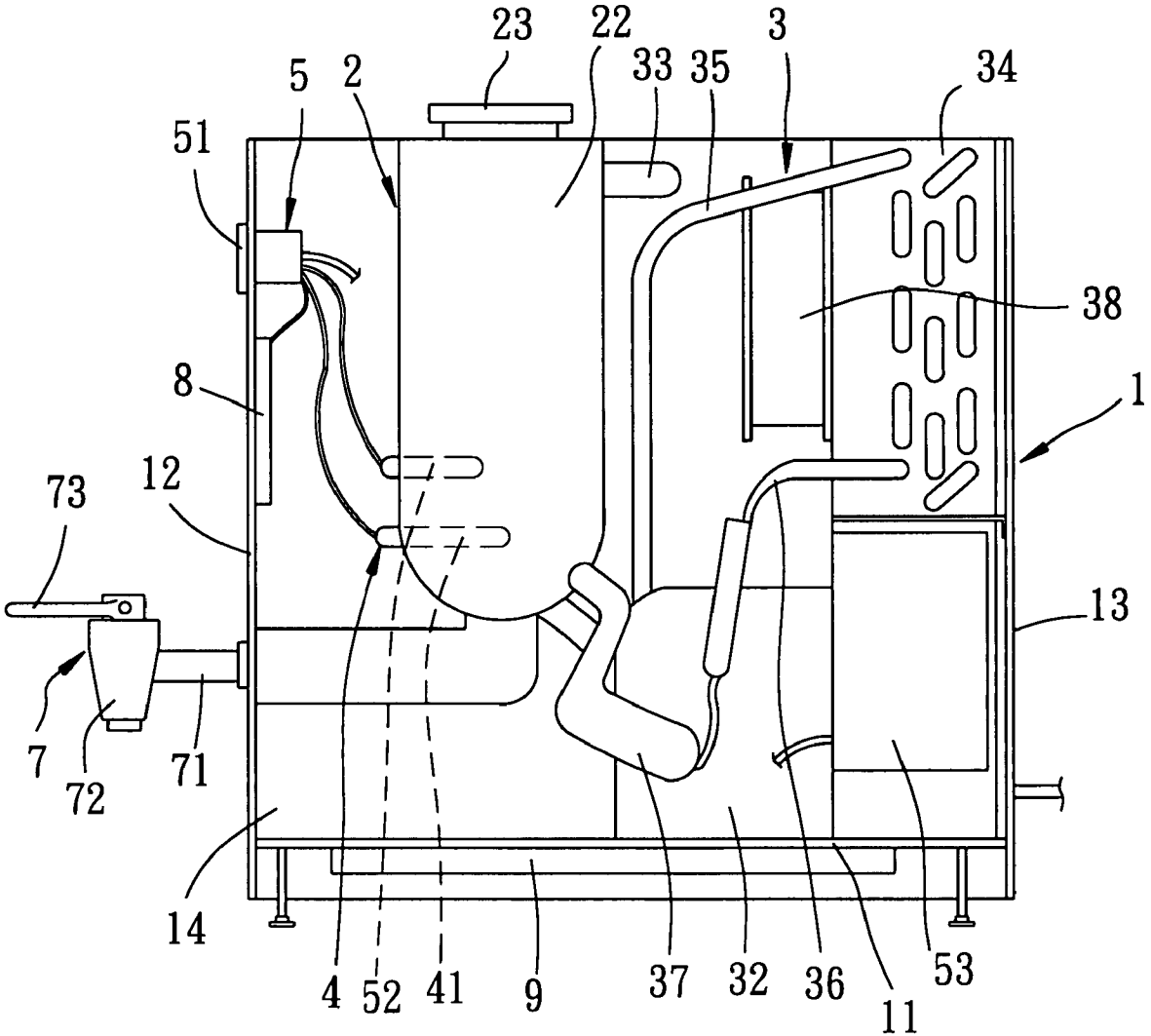
FIGS. 2 and 3 are right and left schematic side views to illustrate an interior of a housing of the preferred embodiment.
Figure 3:
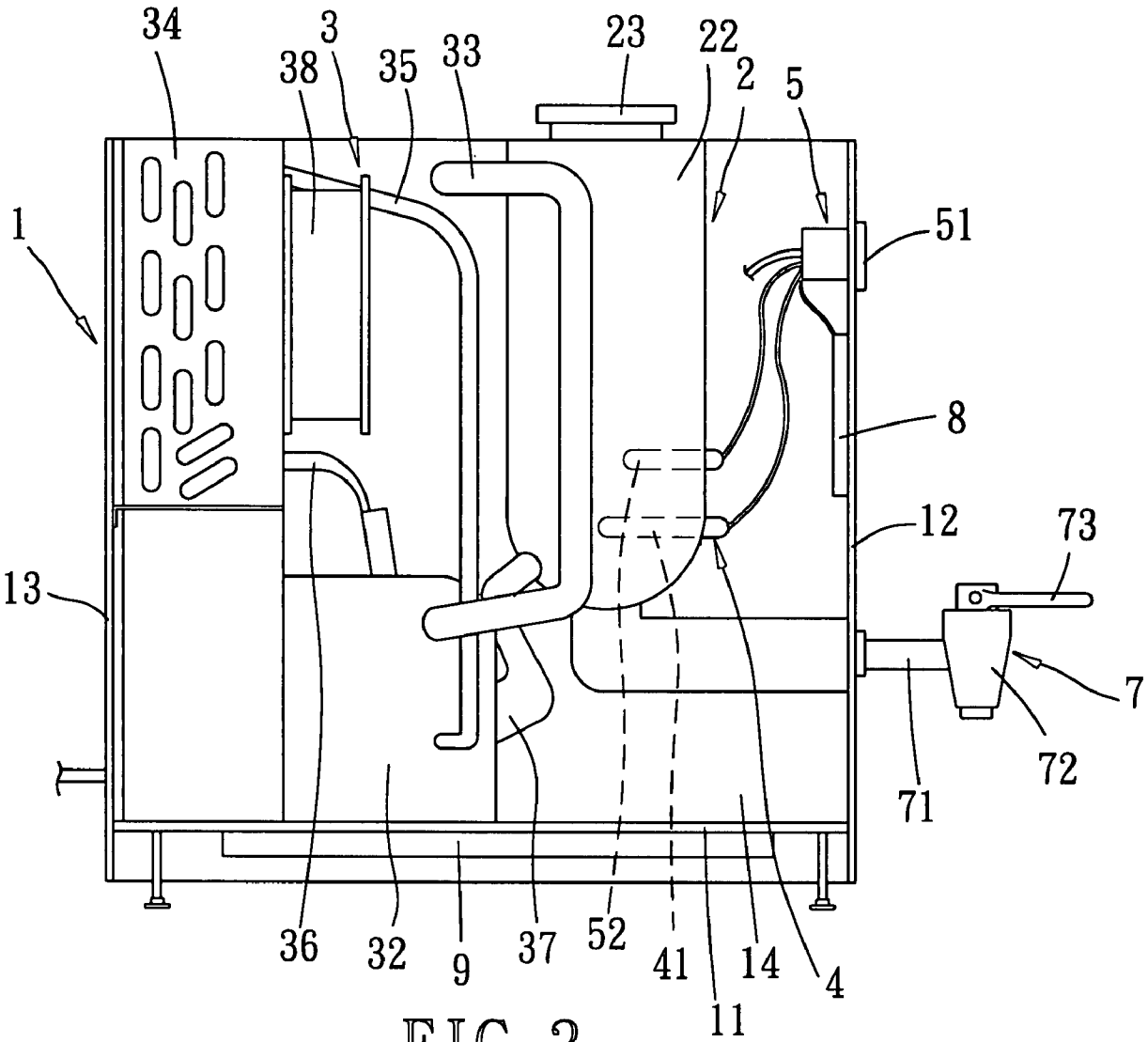
Figure 4:
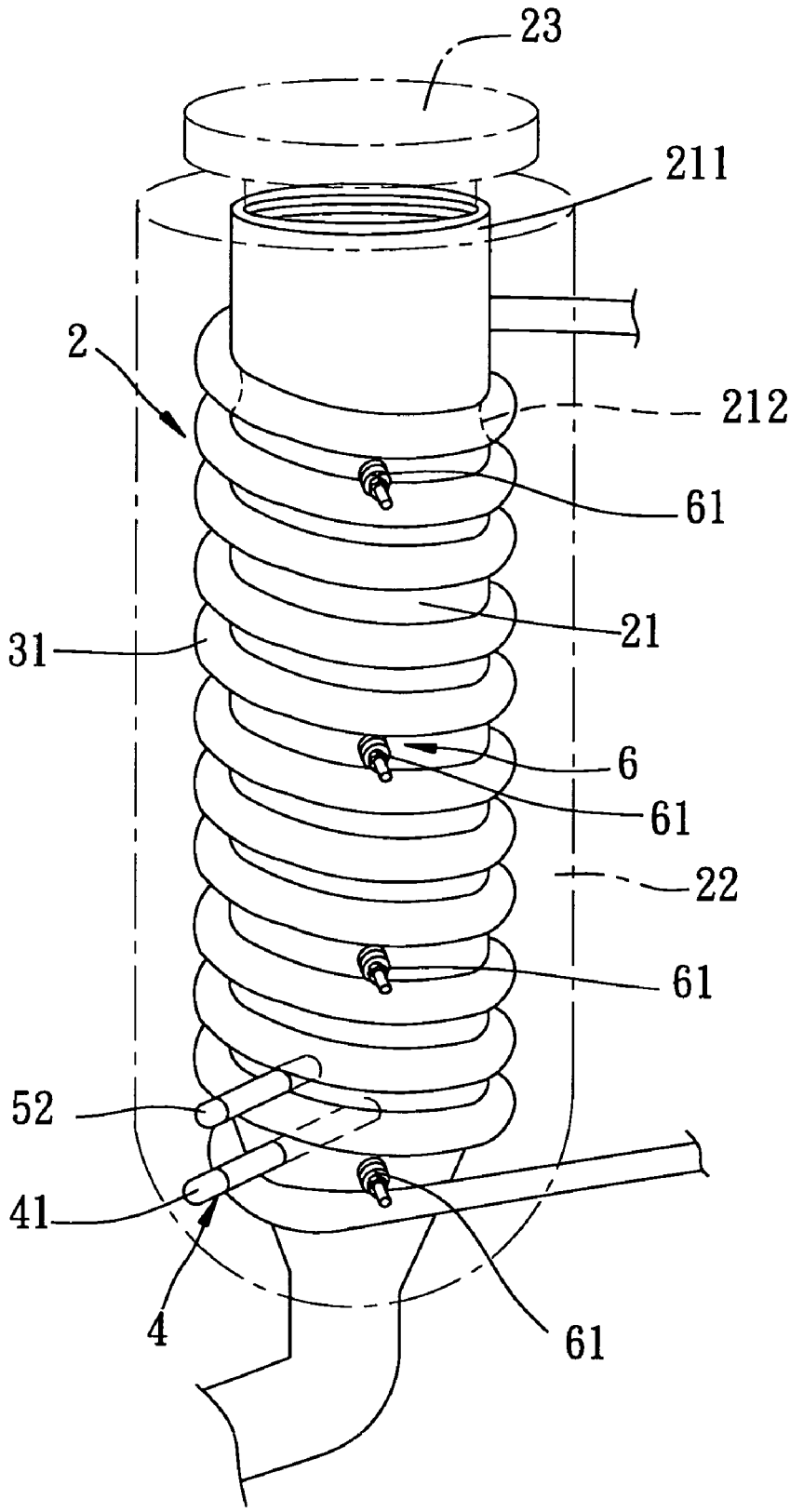
FIG. 4 is a fragmentary perspective view to illustrate a holding tank, a heat-exchanging pipe, an electric heating rod, and a level-sensing probe set of the preferred embodiment.
Figure 5:
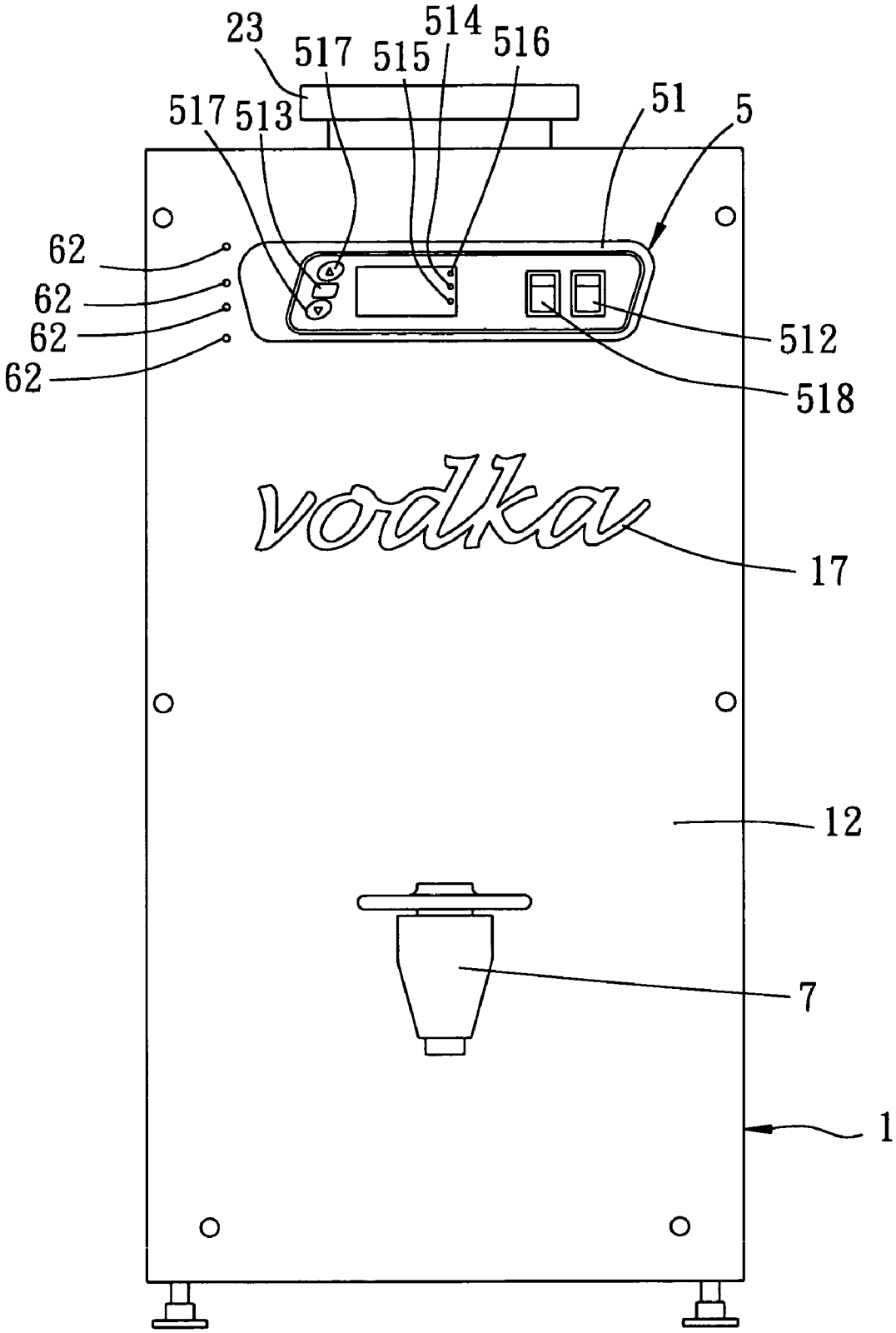
FIG. 5 is a schematic front view of the preferred embodiment.

With reference to FIGS. 2 and 5, the control panel 51 includes a power switch 512 for controlling activation of the temperature setting device 5, a function switch 513 for selecting operation of the temperature setting device 5 in one of the cooling mode and the heating mode, a cooling indicating lamp 514 activated by the control panel 51 when the temperature setting device 5 operates in the cooling mode, a heating indicating lamp 515 activated by the control panel 51 when the temperature setting device 5 operates in the heating mode, a temperature setting indicating lamp 516 activated by the control panel 51 when setting the user-defined value, and a pair of temperature setting keys 517 for setting the user-defined value.

The level-sensing device 6 is used to provide an indication as to level of the alcoholic beverage in the holding tank 2, and includes a level-sensing probe set and a level-indicating lamp set. The level-sensing probe set includes a plurality of level-sensing probes 61 (see FIG. 4) that extend into the inner container 21 of the holding tank 2 at different depths. The level-indicating lamp set is coupled to the level-sensing probe set, and includes a plurality of level-indicating lamps 62 (see FIG. 1) mounted on the front wall 12 of the housing 1. In this embodiment, there are four level-sensing probes 61 and four corresponding level-indicating lamps 62. The level-sensing probe set detects the level of the alcoholic beverage in the holding tank 2 and activates the level-indicating lamp set to indicate the detected level of the alcoholic beverage in the holding tank 2. For example, when all four level-sensing probes 61 are immersed in the alcoholic beverage in the holding tank 2, all four level-indicating lamps 62 are turned on. On the other hand, when the level of the alcoholic beverage in the holding tank 2 drops such that only one of the level-sensing probes 61 is immersed in the alcoholic beverage in the holding tank 2, only a corresponding one of the four level-indicating lamps 62 will be turned on.

The dispensing valve 7 is mounted on the front wall 12 of the housing 1, is coupled to the holding tank 2, and is operable so as to permit discharging of the alcoholic beverage from the holding tank 2. The dispensing valve 7 includes a dispensing pipe 71 connected to the inner container 21 of the holding tank 2, a valve body 72 connected to the dispensing pipe 71 and disposed outside the housing 1, and a lever 73 mounted operably on the valve body 72. By operating the lever 73, the valve body 72 can be selectively opened and closed to control discharging of the alcoholic beverage from the holding tank 2. Since the dispensing valve 7 is conventional in construction, and since its specific construction is not pertinent to the claimed invention, a detailed description of the same is omitted herein for the sake of brevity.

The front lamp unit 8 is a planar lamp, such as a cold light source, mounted on the front wall 12 inside the housing 1 and registered with the decorative cutout 17. The front lamp unit 8 is operable so as to generate light that radiates through the decorative cutout 17 to result in a decorative effect.

The bottom lamp unit 9, such as fluorescent lamp, is mounted under the bottom wall 11 for providing illumination housing 1.

In this embodiment, the control panel 51 is provided with a lamp switch 518 (see FIG. 5) coupled to the front and bottom lamp units 8, 9 for controlling activation and deactivation of the same.

To use the alcoholic beverage dispenser, the power switch 512 is first turned on to activate the temperature setting device 5. Then, the function switch 513 is operated for selecting operation of the temperature setting device 5 in one of the cooling mode and the heating mode. When the cooling mode is selected, the heating device 4 is turned off, and the cooling indicating lamp 514 is turned on. On the other hand, when the heating mode is selected, the cooling device 3 is turned off, and the heating indicating lamp 515 is turned on.

To set the user-defined value in the cooling or heating mode, the function switch 513 is first operated to initiate operation of the temperature setting device 5 in a temperature setting mode. The temperature setting indicating lamp 516 is activated at this time. Then, the temperature setting keys 517 are operated to set the user-defined value. In this embodiment, the user-defined values available for selection in the cooling mode range from room temperature to −12° C.~−15° C., whereas the user-defined values available for selection in the heating mode range from room temperature to 40° C.~50° C.

Referring once again to FIGS. 2 and 6, when the temperature setting device 5 is operated in the cooling mode, and the temperature detected by the temperature sensor 52 is higher than the user-defined value set through the control panel 51, the controller 53 will activate the cooling device 3. During operation, liquid coolant in the heat-exchanging pipe 31 absorbs heat from the inner container 21 of the holding tank 2 and changes into gaseous form. The compressor 32 compresses the gaseous coolant flowing from the heat-exchanging pipe 31 and the first pipe 33, and supplies the same to the heat-dissipating device 34 through the second pipe 35. The coolant condenses in the heat-dissipating device 34 and is subsequently supplied back to the heat-exchanging pipe 31 via the third pipe 36 and the capillary device 37. Circulation of the coolant in the above manner continues until the temperature detected by the temperature sensor 52 is no longer higher than the user-defined value.

When the temperature setting device 5 is operated in the heating mode, and the temperature detected by the temperature sensor 52 is lower than the user-defined value set through the control panel 51, the controller 53 will activate the heating device 4. Particularly, the electric heating rod 41 is connected to a power source (not shown) such that the alcoholic beverage in the holding tank 2 is heated until the temperature detected by the temperature sensor 52 is no longer lower than the user-defined value.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An alcoholic beverage dispenser comprising:

a housing having a top end formed with a beverage inlet;

a holding tank mounted in said housing and in fluid communication with said beverage inlet, said holding tank being adapted to hold an alcoholic beverage that was poured into said housing through said beverage inlet, a cap member disposed removably on said top end of said housing for closing said beverage inlet;

a cooling device mounted in said housing and coupled to said holding tank, said cooling device being operable so as to lower the temperature of the alcoholic beverage held in said holding tank; and a dispensing valve mounted on said housing, coupled to said holding tank, and operable so as to permit discharging of the alcoholic beverage from said holding tank;

wherein said housing includes a bottom wall, a peripheral wall extending upwardly from a periphery of said bottom wall, and a top wall opposite to said bottom wall and connected to said peripheral wall, said top wall being formed with said beverage inlet, said dispensing valve being mounted on said peripheral wall.

2. The alcoholic beverage dispenser as claimed in claim 1, wherein said holding tank includes an inner container made of a heat-conductive material and adapted for holding the alcoholic beverage therein, and said cooling device includes a heat-exchanging pipe wound around said inner container.

3. The alcoholic beverage dispenser as claimed in claim 2, wherein said cooling device further includes:

a compressor;

a first pipe for coupling said compressor to said heat-exchanging pipe;

a heat-dissipating device;

a second pipe for coupling said compressor to said heat-dissipating device;

a third pipe coupled to said heat-dissipating device;

a capillary device interconnecting said third pipe and said heat-exchanging pipe; and a coolant circulating through said heat-exchanging pipe, said first pipe, said compressor, said second pipe, said heat-dissipating device, said third pipe and said capillary device.

4. The alcoholic beverage dispenser as claimed in claim 1, further comprising a temperature setting device mounted on said housing and coupled to said cooling device, said temperature setting device being operable so as to detect the temperature of said holding tank and so as to control operation of said cooling device for lowering the temperature of said holding tank to a user-defined value.

5. The alcoholic beverage dispenser as claimed in claim 4, wherein said temperature setting device includes;

a control panel mounted on said housing and operable so as to set the user-defined value;

a temperature sensor mounted on said holding tank to detect the temperature of said holding tank; and a controller mounted in said housing and coupled electrically to said control panel, said temperature sensor and said cooling device, said controller activating said cooling device when the temperature detected by said temperature sensor is higher than the user-defined value set through said control panel.

6. The alcoholic beverage dispenser as claimed in claim 5, wherein said control panel includes:

a power switch for controlling activation of said temperature setting device;

a cooling indicating lamp activated by said control panel when said controller activates said cooling device; and temperature setting keys for setting the user-defined value.

7. The alcoholic beverage dispenser as claimed in claim 2, further comprising a heating device mounted on said holding tank and operable so as to raise the temperature of the alcoholic beverage held in said holding tank.

8. The alcoholic beverage dispenser as claimed in claim 7, wherein said heating device includes an electric heating rod that extends into said holding tank.

9. The alcoholic beverage dispenser as claimed in claim 7, further comprising a temperature setting device mounted on said housing and coupled to said cooling device and said heating device, said temperature setting device being operable so as to detect the temperature of said holding tank and so as to control operation of one of said cooling device and said heating device for adjusting the temperature of said holding tank to a user-defined value.

10. The alcoholic beverage dispenser as claimed in claim 9, wherein said temperature setting device includes:

a control panel mounted on said housing and operable so as to set the user-defined value and so as to set operation of said temperature setting device in a selected one of a cooling mode and a heating mode;

a temperature sensor mounted on said holding tank to detect the temperature of said holding tank; and a controller mounted in said housing and coupled electrically to said control panel, said temperature sensor, said cooling device and said heating device, said controller activating said cooling device when said temperature setting device is operated in the cooling mode, and the temperature detected by said temperature sensor is higher than the user-defined value set through said control panel, said controller activating said heating device when said temperature setting device is operated in the heating mode, and the temperature detected by said temperature sensor is lower than the user-defined value set through said control panel.

11. The alcoholic beverage dispenser as claimed in claim 10, wherein said control panel includes:

a power switch for controlling activation of said temperature setting device;

a function switch for selecting operation of said temperature setting device in one of the cooling mode and the heating mode;

a cooling indicating lamp activated by said control panel when said temperature setting device operates in the cooling mode;

a heating indicating lamp activated by said control panel when said temperature setting device operates in the heating mode; and temperature setting keys for setting the user-defined value.

12. The alcoholic beverage dispenser as claimed in claim 1, further comprising a level-sensing device for providing an indication as to the level of the alcoholic beverage in said holding tank.

13. The alcoholic beverage dispenser as claimed in claim 12, wherein said level-sensing device includes:

a level-sensing probe set extending into said holding tank; and a level-indicating lamp set mounted on said housing and coupled to said level-sensing probe set;

said level-sensing probe set detecting the level of the alcoholic beverage in said holding tank and activating the level-indicating lamp set to indicate the detected level of the alcoholic beverage in said holding tank.

14. The alcoholic beverage dispenser as claimed in claim 1, further comprising a fan mounted on said housing for dissipating heat generated in said housing.

15. An alcoholic beverage dispenser comprising:

a housing having a top end formed with a beverage inlet;

a holding tank mounted in said housing and in fluid communication with said beverage inlet, said holding tank being adapted to hold an alcoholic beverage that was poured into said housing through said beverage inlet;

a cap member disposed removably on said top end of said housing for closing said beverage inlet;

a cooling device mounted in said housing and coupled to said holding tank, said cooling device being operable so as to lower the temperature of the alcoholic beverage held in said holding tank;

a dispensing valve mounted on said housing, coupled to said holding tank, and operable so as to permit discharging of the alcoholic beverage from said holding tank; and a temperature setting device mounted on said housing and coupled to said cooling device, said temperature setting device being operable so as to detect the temperature of said holding tank and so as to control operation of said cooling device for lowering the temperature of said holding tank to a user-defined value, said temperature setting device including a control panel mounted on said housing and operable so as to set the user-defined value, a temperature sensor mounted on said holding tank to detect the temperature of said holding tank, and a controller mounted in said housing and coupled electrically to said control panel, said temperature sensor and said cooling device, said controller activating said cooling device when the temperature detected by said temperature sensor is higher than the user-defined value set through said control panel.

16. An alcoholic beverage dispenser comprising:

a housing having a top end formed with a beverage inlet;

a holding tank mounted in said housing and in fluid communication with said beverage inlet, said holding tank including an inner container made of a heat-conductive material and adapted to hold an alcoholic beverage that was poured into said housing through said beverage inlet;

a cap member disposed removably on said top end of said housing for closing said beverage inlet;

a cooling device mounted in said housing and coupled to said holding tank, said cooling device being operable so as to lower the temperature of the alcoholic beverage held in said holding tank, said cooling device including a heat-exchanging pipe wound around said inner container;

a dispensing valve mounted on said housing, coupled to said holding tank, and operable so as to permit discharging of the alcoholic beverage from said holding tank;

a heating device mounted on said holding tank and operable so as to raise the temperature of the alcoholic beverage held in said holding tank;

a temperature setting device mounted on said housing and coupled to said cooling device and said heating device, said temperature setting device being operable so as to detect the temperature of said holding tank and so as to control operation of one of said cooling device and said heating device for adjusting the temperature of said holding tank to a user-defined value, said temperature setting device including a control panel mounted on said housing and operable so as to set the user-defined value and so as to set operation of said temperature setting device in a selected one of a cooling mode and a heating mode, a temperature sensor mounted on said holding tank to detect the temperature of said holding tank, and a controller mounted in said housing and coupled electrically to said control panel, said temperature sensor, said cooling device, and said heating device, said controller activating said cooling device when said temperature setting device is operated in the cooling mode, and the temperature detected by said temperature sensor is higher than the user-defined value set through said control panel, said controller activating said heating device when said temperature setting device is operated in the heating mode, and the temperature detected by said temperature sensor is lower than the user-defined value set through said control panel.

17. An alcoholic beverage dispenser comprising:

a housing having a top end formed with a beverage inlet;

a holding tank mounted in said housing and in fluid communication with said beverage inlet, said holding tank being adapted to hold an alcoholic beverage that was poured into said housing through said beverage inlet;

a cap member disposed removably on said top end of said housing for closing said beverage inlet;

a cooling device mounted in said housing and coupled to said holding tank, said cooling device being operable so as to lower the temperature of the alcoholic beverage held in said holding tank;

a dispensing valve mounted on said housing, coupled to said holding tank, and operable so as to permit discharging of the alcoholic beverage from said holding tank; and a level-sensing device for providing an indication as to level of the alcoholic beverage in said holding tank, said level-sensing device including a level-sensing probe set extending into said holding tank, and a level-indicating lamp set mounted on said housing and coupled to said level-sensing probe set, said level-sensing probe set detecting the level of the alcoholic beverage in said holding tank and activating said level-indicating lamp set to indicate the detected level of the alcoholic beverage in said holding tank.

* * * * *